United States Patent [19]

Mausner et al.

[11] 3,951,880

[45] Apr. 20, 1976

[54] ANTI-DUSTING ALPHA-OLEFIN SULFONATE DETERGENT COMPOSITIONS

[75] Inventors: Marvin Mausner, Teaneck; Brij L. Kapur, Paterson, both of N.J.

[73] Assignee: Witco Chemical Corporation, New York, N.Y.

[22] Filed: Feb. 2, 1973

[21] Appl. No.: 329,274

[52] U.S. Cl. ..... 252/555; 252/545; 252/536; 252/548

[51] Int. Cl.[2] ..... C11D 1/12

[58] Field of Search ..... 252/555, 545, 536, 548

[56] References Cited

UNITED STATES PATENTS

| | | | |
|---|---|---|---|
| 3,640,880 | 2/1972 | Martin | 252/545 |
| 3,676,372 | 7/1972 | Sharman | 252/536 |
| 3,707,511 | 12/1972 | Lamberti et al. | 252/555 |
| 3,738,935 | 6/1973 | Woo | 252/555 |
| 3,741,915 | 6/1973 | Paviak | 252/555 |
| 3,776,861 | 12/1973 | Mausner et al. | 252/545 |

*Primary Examiner*—Leland A. Sebastian
*Assistant Examiner*—B. Hunt
*Attorney, Agent, or Firm*—Albert L. Gazzola; Jordan J. Driks; Morton Friedman

[57] ABSTRACT

The marked dusting characteristics of dry powder alkali-metal salts of alpha-olefin sulfonates are substantially inhibited by incorporating therein minor proportions of alkanolamine salts of alpha-olefin sulfonates.

9 Claims, No Drawings

ANTI-DUSTING ALPHA-OLEFIN SULFONATE DETERGENT COMPOSITIONS

This invention relates to improved alpha-olefin sulfonate detergent compositions and to a method for inhibiting the dusting tendencies of alkali metal alpha-olefin sulfonates.

Detergent compositions which contain sodium or potassium alpha-olefin sulfonates, for instance, as the principal active detergent ingredient have become of considerable commercial interest. A particular problem encountered in the preparation of these olefin sulfonate formulations is a marked tendency toward dusting of the dry powder and when formulated as dry beads or flakes, a poor quality finished product results because the dried beads or flakes also tend to break down and dust excessively during packaging, handling, and final end use. Detergent compositions having such fragile physical qualities are for the most part unattractive for commercial purposes. In accordance with the present invention there has been discovered a process for substantially inhibiting the dusting tendencies of the alkali metal salts of a sulfonated $C_{10}$–$C_{22}$ alpha-olefin sulfonate detergent, which comprises admixing therewith from about 10 to 35% by weight, based on the weight of said salt of a commercially available alkanolamine salt, such as the mono-, di-, or tri- ethanolamine, propanolamine, or isopropanolamine salt, for instance, of said $C_{10}$–$C_{22}$ alpha-olefin sulfonate, particularly preferred is the diethanolamine salt at about 25% by weight.

Incorporation of the aforesaid alkanolamine salt of sulfonated alpha-olefin substantially inhibits the dusting problem heretofore commonplace when a sodium or potassium alpha-olefin sulfonate detergent products are prepared in dry particulate form, either as beads or flakes, and in these final products.

The alpha-olefins, which are sulfonated to form the detergents described in the process of the present invention, usually contain from about 10 to 22 carbon atoms and more particularly about 12 to 18 carbon atoms. They may be derived from a variety of processes such as, for example, by wax cracking, ethylene build up, or dehydration of the corresponding primary alcohol.

Exemplary alpha-olefins are 1-decene, 1-undecene, 1-dodecene, 1-tridecene, 1-tetradecene, 1-pentadecene, 1-hexadecene, 1-heptadecene, 1-octadecene and the like and mixtures of the aforesaid. Sulfonation of these long chain olefins is typically carried out utilizing sulfur trioxide mixed with a diluent. After the sulfonation is completed, neutralization and hydrolysis of the acid mixture is carried out so that any by-product sultones which may be formed are converted to the corresponding hydroxy-alkane sulfonates. Thus, as is well known in the art as evidenced by U.S. Pat. Nos. 3,332,876 issued to Walker on July 25, 1967, and 3,506,580, issued to Rubinfeld et al on Apr. 14, 1970, the term olefin sulfonate detergent as used herein includes not only the alkene sulfonate itself but also admixtures of same formed as a result of the usual sulfonation, neutralization, and hydrolysis procedures, with substantial proportions of the corresponding water soluble hydroxy-alkane sulfonates. Generally speaking, alpha-olefin sulfonate detergents used in the compositions of the present invention are composed of about 40 to 80% of alkene sulfonate itself and about 50–20% of the corresponding hydroxy-alkane sulfonate, and usually about 50% of each of the aforesaid makes up the alpha-olefin sulfonate detergent.

The aforesaid admixture of alkanolamine alpha-olefin sulfonate with alkali metal alpha-olefin sulfonates may be simply dry blended together when the final product is to be prepared in flaked form and a dust free flake is desired, or the blend may be slurried and spray dried when a bead is desired, i.e. the finished product is prepared by spray drying an aqueous slurry of the above ingredients or of the various ingredients of the finished composition, such as builders and additives as well as active ingredients. The spray dried bead thus produced from the slurry is extremely durable and exhibits substantially suppressed dusting tendencies.

Alternatively, and preferably, because of convenience and economy, the mixture of alkanolamine alpha-olefin sulfonate with alkali metal alpha-olefin sulfonate may be accomplished by neutralizing a dilute solution of an acid such as sulfuric, hydrochloric or phosphoric acid, with the alkanolamine. After adding the alkali metal alpha-olefin sulfonate, to the solution, an exchange of the alkali metal and alkanolamine cations takes place and when the final solution is dried, as above, the low dusting product of the present invention is obtained.

The invention is, as discussed above, applicable to built detergent compositions wherein the aforesaid alpha-olefin sulfonate detergent with suppressed dusting tendencies is combined with other ingredients conventionally employed in finished commercial formulations. Such compositions generally contain substantial amounts of an inorganic metal sulfate filler such as sodium or potassium sulfate as well as the various inorganic builders and fillers such as the condensed phosphates, silicates, the various carbonates, borates and the like as known in the art.

Although only commercially readily available alkanolamines are hereinabove described, other lower alkanolamines which are not so readily available at present, having up to 6 carbon atoms, for instance, although not preferred, are included in the spirit of the present invention.

Various blends exemplary of the present invention, are prepared by drying aqueous slurries of sodium $C_{14}$–$C_{16}$ alpha-ofefin sulfonate detergents (17.5% active) with sodium sulfate in which are incorporated various proportions of the indicated ethanolamine so as to give an alkanolamine-sodium salt blend in the proportions listed below.

The extent of inhibition of dusting is measured in terms of dust settling time. Settling time is measured by placing a 20 gram sample of drum dried material, for instance, in an 8 oz. glass jar, inverting the jar and noting the time for the dust to settle. All samples contain about 17.5% total alpha-olefin sulfonate blended with about 83.5% sodium sulfate. The percentages refer to the proportions of sodium or ethanolamine alpha-olefin sulfonate relative to each other.

| | SAMPLE COMPOSITIONS | SETTLING TIME |
|---|---|---|
| (a) | 100% Sodium AOS* | 10–11 seconds |
| (b) | 50% Sodium AOS<br>50% Potassium AOS | 12 seconds |
| (c) | 10% MEA* AOS<br>90% Sodium AOS | 6.8 seconds |
| (d) | 15% MEA AOS<br>85% Sodium AOS | 7.5 seconds |
| (e) | 15% DEA* AOS | 5.0 seconds |

-continued

| | SAMPLE COMPOSITIONS | SETTLING TIME |
|---|---|---|
| | 85% Sodium AOS | |
| (f) | 20% TEA* AOS | 6.0 seconds |
| | 80% Sodium AOS | |
| (g) | 20% MEA AOS | 3.5 seconds |
| | 80% Sodium AOS | |
| (h) | 25% DEA AOS | 1 second |
| | 75% Sodium AOS | No dust observable |
| (i) | 30% DEA AOS | 1 second |
| | 70% Sodium AOS | No dust observable |
| (j) | 35% DEA AOS | 1 second |
| | 65% Sodium AOS | No dust observable |

*AOS represents alpha-olefin sulfonate

*MEA, DEA and TEA represent, respectively, mono-, di-, and triethanolamine.

What is claimed is:

1. A process for suppressing the dusting tendencies of an alkali metal salt of a $C_{10}$–$C_{22}$ alpha-olefin sulfonate detergent which comprises incorporating therein from about 10 to 35% by weight of a lower alkanolamine salt of said alpha-olefin sulfonate.

2. A process according to claim 1 wherein said alkanolamine salt is selected from the group consisting of ethanolamine, propanolamine and isopropanolamine.

3. A process according to claim 1 wherein there is admixed about 25% by weight of diethanolamine salt.

4. A process according to claim 1 wherein said alpha-olefin contains from 12 to 18 carbon atoms.

5. A substantially dry particulate composition consisting essentially of an alkali metal salt of a $C_{10}$–$C_{22}$ alpha-olefin sulfonate admixed with about 10–35% by weight of a lower alkanola mine salt of said sulfonate.

6. A composition according to claim 5 wherein said alpha-olefin contains from 12 to 18 carbon atoms.

7. A composition according to claim 5 wherein said alkanolamine salt is a diethanolamine salt in a concentration of about 25% by weight.

8. A composition according to claim 5 wherein said alkali metal is sodium.

9. A built detergent composition containing the dry particulate composition of claim 5.

* * * * *